US011700478B2

(12) United States Patent
Ning

(10) Patent No.: US 11,700,478 B2
(45) Date of Patent: Jul. 11, 2023

(54) HEADPHONE AND MULTI-STAGE NOISE-CANCELLATION EARPHONE ASSEMBLY

(71) Applicant: BEIJING XIAOMI MOBILE SOFTWARE CO., LTD., Beijing (CN)

(72) Inventor: Penggang Ning, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/565,363

(22) Filed: Dec. 29, 2021

(65) Prior Publication Data

US 2022/0353604 A1 Nov. 3, 2022

(30) Foreign Application Priority Data

Apr. 28, 2021 (CN) ..... 202110469187.X

(51) Int. Cl.
*H04R 1/10* (2006.01)
*G10K 11/178* (2006.01)

(52) U.S. Cl.
CPC ..... *H04R 1/1083* (2013.01); *G10K 11/17821* (2018.01); *H04R 1/1008* (2013.01); *H04R 1/1016* (2013.01); *H04R 1/1025* (2013.01); *H04R 2420/07* (2013.01); *H04R 2460/01* (2013.01)

(58) Field of Classification Search
None
See application file for complete search history.

(56) References Cited

U.S. PATENT DOCUMENTS

2011/0268290 A1 11/2011 Lee
2017/0208380 A1* 7/2017 Slater ..... H04R 1/1083
2018/0146279 A1 5/2018 Wang et al.
2019/0379962 A1* 12/2019 Navid ..... H04R 1/38
2020/0077171 A1 3/2020 Chi-Hsueh et al.
2021/0314691 A1* 10/2021 Campbell ..... G10K 11/17885

FOREIGN PATENT DOCUMENTS

WO 2020131963 A1 6/2020

OTHER PUBLICATIONS

Extended European Search Report of EP Application No. 21218119.2 dated Jun. 30, 2022, (8p).

* cited by examiner

*Primary Examiner* — Kenny H Truong
(74) *Attorney, Agent, or Firm* — Arch & Lake LLP

(57) ABSTRACT

A headphone is configured to be used in combination with an in-ear earphone, and includes: an earmuff configured to be fitted over an auricle; an earmuff pickup arranged on an outer side of the earmuff and configured to collect an environmental sound; and a first speaker arranged on an inner side of the earmuff and configured to perform at least one of following actions: playing a noise-cancellation sound corresponding to the environmental sound collected by the earmuff pickup, or playing an audio. When the headphone is in use, the inner side of the earmuff and the auricle define an accommodating space for accommodating a part of the in-ear earphone exposed out of an external auditory canal. The headphone and the auricle define an accommodating space for accommodating the in-ear headphone.

19 Claims, 3 Drawing Sheets

HEADPHONE AND MULTI-STAGE NOISE-CANCELLATION EARPHONE ASSEMBLY

CROSS-REFERENCE TO RELATED APPLICATION

The present disclosure is based on and claims priority to Chinese Patent Application No. 202110469187.X, field on Apr. 28, 2021, the entire content of which is incorporated herein by reference for all purposes.

FIELD

The present disclosure relates to a field of earphones, and more particularly to a headphone and a multi-stage noise-cancellation earphone assembly.

BACKGROUND

In a related art, a noise-cancellation earphone can be divided into two categories, one is a head-mounted earmuff that wraps the ear, and the other one is an in-ear earplug that is inserted into the ear. Regardless of the former or the latter, passive noise-cancellation materials are used as much as possible to absorb noise so as to create a closed space, and then active noise-cancellation technology is used to cancel noise. However, the effects of the two categories are weak. The head-mounted earmuff has advantages of bone conduction reduction and long battery life. The in-ear earplug has a small sound space, which is more conducive to active noise cancellation. At present, the noise-cancellation effect of the in-ear earplug is substantively the same with that of the head-mounted earmuff, but they both cannot achieve the mute effect understood by consumers.

SUMMARY

The present disclosure provides a headphone and a multi-stage noise-cancellation earphone assembly.

According to a first aspect of the present disclosure, a headphone is provided. The headphone is configured to be used in combination with an in-ear earphone, and includes: an earmuff configured to be fitted over an auricle; an earmuff pickup arranged on an outer side of the earmuff and configured to collect an environmental sound; and a first speaker arranged on an inner side of the earmuff and configured to perform at least one of following actions: playing a noise-cancellation sound corresponding to the environmental sound collected by the earmuff pickup, or playing an audio. When the headphone is in use, the inner side of the earmuff and the auricle define an accommodating space for accommodating a part of the in-ear earphone exposed out of an external auditory canal.

According to a second aspect of the present disclosure, a multi-stage noise-cancellation earphone assembly is provided, including a headphone and an in-ear earphone. The headphone includes: an earmuff configured to be fitted over an auricle; an earmuff pickup arranged on an outer side of the earmuff and configured to collect an environmental sound; and a first speaker arranged on an inner side of the earmuff and configured to perform at least one of following actions: playing a noise-cancellation sound corresponding to the environmental sound collected by the earmuff pickup, or playing an audio. The inner side of the earmuff is configured to define an accommodating space with the auricle when the headphone is in use. When the multi-stage noise-cancellation earphone assembly is in use, an in-ear end of the in-ear earphone is located in the external auditory canal, and a part of the in-ear earphone exposed out of the external auditory canal is located in the accommodating space.

It should be understood that the above general description and the following detailed description are only illustrative and explanatory and cannot limit the present disclosure.

BRIEF DESCRIPTION OF THE DRAWINGS

The drawings herein are incorporated into the description and constitute a part of the description. The drawings show examples that conform to the present disclosure, and are used together with the description to explain the principle of the present disclosure.

DETAILED DESCRIPTION

Figure 1:
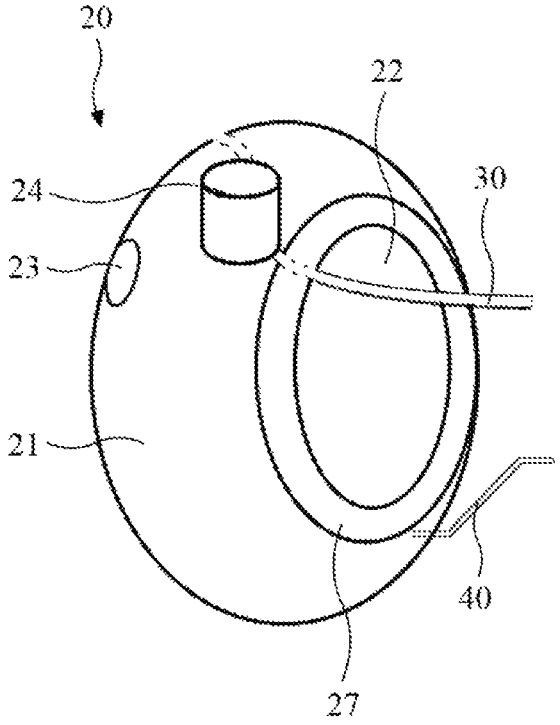
FIG. 1 is a partial schematic view of a headphone according to an example of the present disclosure.

Illustrative embodiments will be described in detail herein, examples of which are illustrated in the drawings. When the following description refers to the drawings, same numerals in different drawings refer to the same or similar elements, unless otherwise indicated. The implementations described in the following illustrative embodiments do not represent all embodiments consistent with the present disclosure. Instead, they are merely examples of devices and methods consistent with some aspects of the present disclosure, as detailed in the appended claims.

Headphones with noise-cancellation technology can bring people more optimized sound effects. The current noise-cancellation technology includes active noise cancellation and passive noise cancellation. The active noise cancellation is to generate a reverse sound wave equal to an external noise through a noise-cancellation system to neutralize the noise, thereby achieving the noise-cancellation effect. The passive noise cancellation includes noise cancellation at a sound source, noise cancellation during propagation, and noise cancellation at the human ear. The passive noise cancellation at the human ear is mainly implemented by surrounding the ear to form a closed space, or using sound-insulating materials such as silicone earplugs to block the external noise.

For the passive noise cancellation, since the working principle of a passive noise-cancellation earphone does not involve the processes of collection and calculation, the structure of the passive noise-cancellation headphone is simple and reliable, and its manufacturing requirement and technical content are relatively low. In addition, because the passive noise-cancellation earphone does not cause interference to the music itself, the sound quality of the passive noise-cancellation earphone is better than that of an active noise-cancellation headphone. Most importantly, the passive noise-cancellation earphone does not need a battery and can be used at any time. Therefore, this technology is widely applied to an in-ear earphone, and current various in-ear earphones are typical passive noise-cancellation earphones.

The active noise-cancellation earphone is even more demanding. Because the most advanced electronic device is used to collect and process the surrounding noise, the noise-cancellation effect of the active noise-cancellation earphone is significantly better than that of the passive noise-cancellation earphone. However, since the entire noise-cancellation process is a computational process, it may affect the sound quality of the earphone to some extent. In addition, the active noise-cancellation earphone must have a power supply.

According to an example of the present disclosure, a headphone is provided. As shown in FIG. 1, the headphone includes: an earmuff configured to be fitted over an auricle; an earmuff pickup arranged on an outer side of the earmuff to collect an environmental sound; and a first speaker arranged on an inner side of the earmuff to play a noise-cancellation sound corresponding to the environmental sound collected by the earmuff pickup, and/or to play an audio. When the headphone is in use, the inner side of the earmuff and the auricle define an accommodating space for accommodating a part of an in-ear earphone exposed out of an external auditory canal. The speaker, also known as a horn, is an electro-acoustic device that can convert electrical energy into sound energy. The principle of the speaker is that a current passes through a coil in a magnetic circuit composed of magnets to generate driving forces in up and down directions to vibrate a vibrating body, and then the air vibrates to make a sound.

In an example, the headphone 20 includes an earmuff 21. The earmuff 21 can be fitted over an in-ear earphone 10. Specifically, the earmuff 21 is arranged at an auricle 51, and an accommodating space is defined between the earmuff 21 and the auricle 51 for accommodating a part of the in-ear earphone 10 exposed out of an external auditory canal 52. The earmuff 21 can be fitted over the auricle 51 and fitted with the auricle 51. Since the in-ear earphone 10 is inserted into the external auditory canal 52, when the earmuff 21 is arranged at the auricle 51, the in-ear earphone 10 is covered.

The earmuff 21 of the headphone 20 is arranged outside the in-ear earphone 10. On one hand, when used in winter, the headphone can keep warm, protect the auricle 51 from cold, and ensure the normal use of the in-ear earphone 10 in cold weather. On the other hand, the earmuff 21 is arranged outside the in-ear headphone 10, the effect of a sound box can be achieved, thus improving the sound quality of the in-ear headphone 10. At last, since the earmuff 21 is fitted over the in-ear headphone 10 and fitted with the auricle 51, a relatively closed environment is formed from the auricle 51 to an entrance of the external auditory canal 52, which reduces the interference of the external noise and improves the audio playing effect of the in-ear earphone 10.

In an example, the headphone 20 further includes a first speaker 22 arranged on an inner side of the earmuff 21, that is, the first speaker 22 is arranged at an end adjacent to the auricle 51. An audio played by the first speaker 22 causes the air in the external auditory canal 52 to vibrate, the vibration reaches a tympanic membrane to cause a mechanical movement of an ossicular chain, the vibration of a stapes footplate causes a movement of a vestibular window, the energy is transferred to inner and outer lymph fluids in a cochlea and becomes liquid vibration, the movement of hair cells on a basement membrane produces a bioelectrical activity, and nerve impulses reach the auditory cortex center along uploading nerve pathways by virtue of the auditory nerve to produce hearing.

In an example, the headphone 20 further includes an earmuff pickup 23. The earmuff pickup 23 is arranged on an outer side of the earmuff 21 for collecting the environmental sound. Specifically, an active noise-cancellation system must have a pickup, a processing chip, and a speaker. The pickup is such a device that can collect a live environmental sound and then transmit it to a back-end device. The pickup includes a microphone, a circuit board, a signal transmission cable, or the like. The headphone 20 is provided with the earmuff pickup 23 arranged on the outer side of the earmuff 21 to collect an external environmental sound. The microphone of the earmuff pickup 23 can sample the noise heard by the human ear and the sampled noise is then transmitted to the processing chip in the headphone 20 via the circuit board and the signal transmission cable. The processing chip reverses and amplifies the noise collected by the earmuff pickup 23, and then drives the first speaker 22 to play an "anti-noise". Playing the "anti-noise" is to play a noise-cancellation sound corresponding to the environmental sound collected by the earmuff pickup 23, so as to cancel the noise transmitted from the outside into the human ear through the earmuff 21. From this, it can be seen that based on the combination of the earmuff pickup 23 and the first speaker 22 of the headphone 20, the headphone 20 can achieve the active noise cancellation. It should be noted that when the headphone 20 is used in combination with the in-ear earphone 10, the first speaker 22 of the headphone 20 is only configured to play the noise-cancellation sound corresponding to the environmental sound collected by the earmuff pickup 23 rather than playing an audio selected by a user. The audio selected by the user is played by a second speaker 11 of the in-ear earphone 10. When the headphone 20 is used separately, the first speaker 22 of the headphone 20 can simultaneously play the noise-cancellation sound corresponding to the environmental sound collected by the earmuff pickup 23 and the audio selected by the user.

The purpose of the headphone 20 including the first speaker 22 and the earmuff pickup 23 is that the headphone 20 is provided with the earmuff 21 that can be fitted over the part of the in-ear earphone 10 exposed out of the external auditory canal 52. When the headphone 20 is used separately, the first speaker 22 can play the audio and the noise-cancellation sound corresponding to the environmental sound collected by the earmuff pickup, thereby achieving the active noise cancellation. When the headphone 20 is used in combination with the in-ear earphone 10, the first speaker 22 can play the noise-cancellation sound corresponding to the environmental sound collected by the earmuff pickup, thereby providing an environment after the active noise cancellation for the in-ear earphone 10 and reducing the interference of the external noise. Moreover, the headphone 20 can be detached, so that the in-ear earphone 10 can be used separately or the headphone 20 can be used separately. When the headphone 20 is used separately, the pressure of the headphone 20 on the auricle 51 is small. Since the headphone 20 can be separated from the earphone 10 and used separately, the user can use different earphones in different environments. In a noisy and irregular environment, the user can choose the in-ear earphone 10, and the in-ear earphone 10 can partially blocks mid-frequency and high-frequency noises, but cannot obviously block low-frequency noise. In a relatively quiet and regular environment, the headphone 20 can be selected. For example, the active noise cancellation can effectively cancel the low-frequency noise by more than 80%, and most of the noises in life is the low-frequency noise, such as environmental noises in scenes such as buses, subways, high-speed rails, trains, cars, buses, airplanes, gyms, bars, etc.

In some examples, the headphone 20 further includes: an air inlet, an air blower 24 and an air duct 30. The air inlet is arranged on the outer side of the earmuff 21, the air blower 24 is arranged on the earmuff 21 and in communication with the air inlet, and the air duct 30 is configured to communicate the air inlet with the in-ear earphone 10. When the headphone 20 is used in combination with the in-ear earphone 10, the air duct 30 may allow the air outside the earmuff 21 to enter the in-ear earphone 10 and further enter the external auditory canal 52.

In some examples, the headphone 20 further includes a charging cable 40. The charging cable 40 is configured to connect the headphone 20 to a battery 15 of the in-ear earphone 10.

In this example, the in-ear earphone 10 is provided with the battery 15, and power stored in the battery 15 can power the in-ear earphone 10. When the in-ear earphone 10 enables an active noise-cancellation mode, both an earphone pickup 12 and the processing chip require power supply.

The headphone further includes a charging cable 40, and the charging cable 40 can charge the battery 15 of the in-ear earphone 10. That is, one end of the charging cable 40 is connected to the in-ear earphone 10, and the other end of the charging cable 40 may be connected to a plug, or the other end of the charging cable 40 may also be connected to the headphone 20. In other words, the battery 15 of the in-ear earphone 10 can be charged by an external charging device. When the in-ear earphone 10 is used in combination with the headphone 20, the battery 15 of the in-ear earphone 10 may be charged by the headphone 20.

In addition, when the headphone 20 charges the battery 15 of the in-ear earphone 10, the two ends of the charging cable 40 are respectively connected to the headphone 20 and the battery 15 of the in-ear earphone 10, and the two ends of the charging cable 40 can be separated from the headphone 20 and the earphone 10, which ensures the comfort and aesthetics of the headphone 20 and the earphone 10 when they are used separately. The headphone 20 in this case may be configured as a wireless earphone or a wired earphone. Further, when the in-ear earphone 10 is low in power, the headphone 20, as a supporting device, can be used as a power supply to charge the in-ear earphone 10. After being charged, the in-ear earphone 10 can be used separately; or, the headphone 20 can be used in combination with the in-ear earphone 10 while charging the in-ear earphone 10.

In some examples, the headphone 20 further includes a skeleton 25. Two ends of the skeleton 25 are each connected to one earmuff 21, and a side of the skeleton 25 facing the head is provided with a support body 26 for preventing the skeleton 25 from coming into contact with the head.

Figure 2:
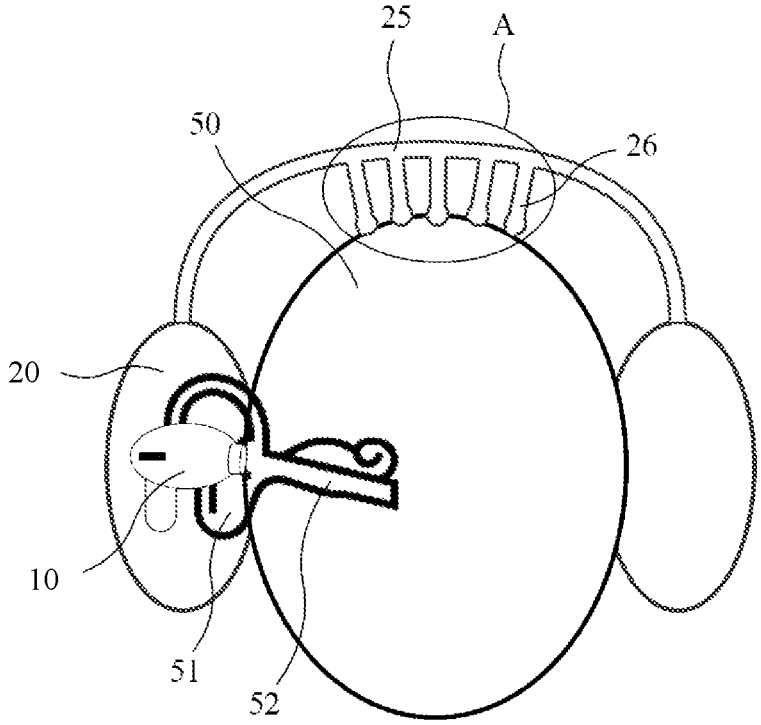
FIG. 2 is a schematic view showing a use position of a multi-stage noise-cancellation earphone assembly according to an example of the present disclosure.

As shown in FIG. 2, the skeleton 25 for connection is often arranged between two earmuffs 21 of the headphone 20. The two ends of the skeleton 25 are each connected to one earmuff 21. When the headphone 20 is worn, the skeleton 25 is in contact with a head 50 of the user. When the headphone 20 does not need to be worn, the skeleton 25 can be hung on the neck of the user. Therefore, the skeleton 25 can prevent the earmuff 21 from sliding and falling off to be broken or lost under the action of gravity, or prevent the earmuff 21 from falling off due to strong vibration during exercise. In addition, since the skeleton 25 is in contact with the head 50 of the user, the skeleton 25 has an arc shape, and the bending radian of the skeleton 25 corresponds to the radian of the head 50 or the neck of the user, which can ensure the user's comfort. The skeleton 25 may have a flat structure, so that the contact area between the headphone 20 and the head 50 is large and the pressure is small. The skeleton 25 may be made of materials such as polystyrene, polyvinyl chloride, or polytetrafluoroethylene. Moreover, the skeleton 25 has elasticity and a clamping force. When the user uses the headphone 20, the clamping force of the skeleton 25 allows the earmuffs 21 at the two ends of the skeleton 25 to be fitted with the auricle 51 of the ears more closely, so that a more closed space is formed between the earmuff 21 and the auricle 51, and thus a better passive noise-cancellation effect is achieved, thereby improving the user experience.

As shown in FIG. 2, the support body 26 is arranged on the side of the skeleton 25 facing the user's head 50. When the user wears the headphone 20, the support body 26 can separate the skeleton 25 from the user's head 50 by a certain distance without contact. On one hand, the headphone 20 can be adapted to the head shapes of different users to become more fit and stable. On the other hand, the support body 26 ensures a distance between the skeleton 25 and the head 50, which can prevent the skeleton 25 from pressing against the head 50 and ruining the hairstyle, thereby solving the problem that the skeleton 25 crushes the hair and ruins the hairstyle. In addition, when the user wears the headphone 20 during exercise, the distance between the skeleton 25 and the head 50 also helps to dissipate heat, and can also prevent the skeleton 25 from erosions by perspiration or the like on the user's head 50, so as to effectively prevent sweat erosion, thereby prolonging the service life of the skeleton 25.

In addition, a side of the support body 26 in contact with the head 50 may have an arc shape which corresponds to the radian of the head 50. The support body 26 may be fixedly arranged on the skeleton 25 or may be detachably arranged on the skeleton 25. The user may also adjust the length of the support body 26 according to the intensity of exercise or the use temperature, that is, the distance between the skeleton 25 and the user's head 50 can be adjusted. By adjusting the length of the support body 26, the headphone 20 can be adapted to the heads 50 of different users. Specifically, the user adjusts the length of the support body 26 according to the size or shape of the head 50, so that the head 50 can come into contact with the headphone 20 through three points, including two earmuffs 21 and one support body 26, and thus the user feels more comfortable and stable when wearing the headphone 20.

Figure 5:
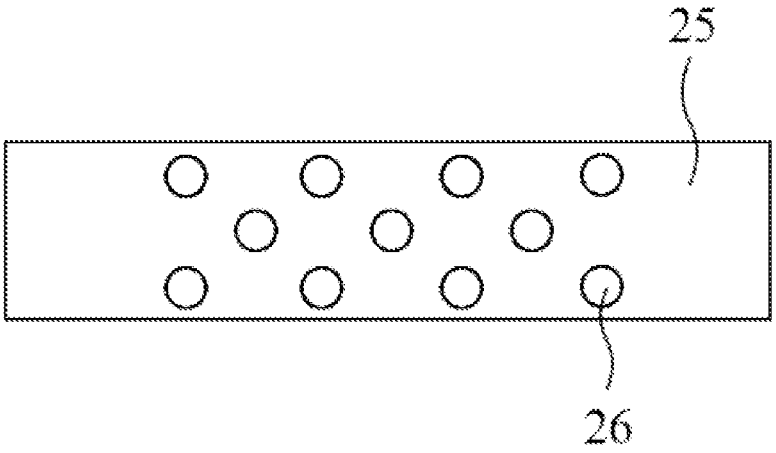
FIG. 5 is an enlarged bottom view of part A in FIG. 2.

In some examples, the support body 26 includes a plurality of support pillars, and the plurality of support pillars are distributed on the skeleton 25 at intervals in an array. As shown in FIG. 2, one end of each support column is arranged on the side of the skeleton 25 adjacent to the head 50, and the other end of the support column is provided with an arc-shaped ball. When the arc-shaped ball is in contact with the user's head 50, the user's head 50 can be prevented from being scratched by the support column. The support body 26 includes the plurality of support pillars which can increase the ventilation environment and save materials. As further shown in FIG. 5 which is an enlarged bottom view of part A in FIG. 2, the plurality of support pillars may be arranged in columns and lines on the side of the skeleton 25 facing the head 50. The support pillars in two adjacent columns are staggered in a longitudinal direction, and the support pillars in two adjacent rows are staggered in a transverse direction, so that the plurality of support pillars are uniformly distributed on the skeleton 25, and thus an even force can be applied to the head 50, thereby improving the stability of the headphone 20 worn on the head 50 and enhancing the comfort of the user wearing the headphone 20. In addition, each support column may also be provided therein with a vibration motor which can cause the support column to vibrate. The plurality of vibrating support pillars, in combination with the arc-shaped balls at the ends of the plurality of support pillars in contact with the head 50, can massage the scalp of the user's head 50. In addition, as shown in FIG. 2, the support pillars are not of the same length, so that the ends of the plurality of support pillars adjacent to the head 50 form an arc surface corresponding to the head 50, thereby improving the comfort of the user.

Figure 3:
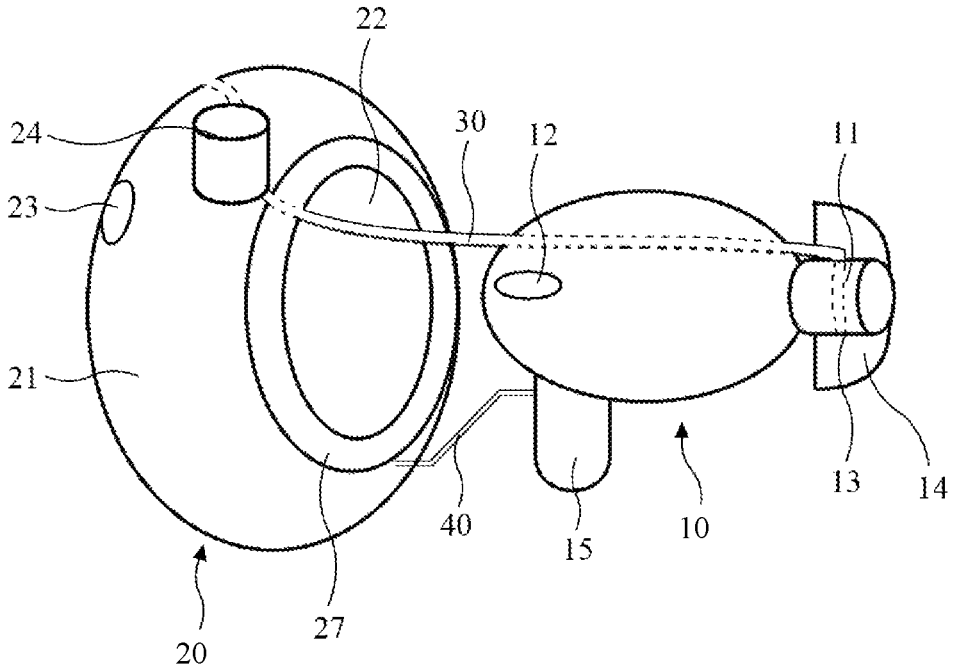
FIG. 3 is a partial schematic view of an in-ear earphone in combination with a headphone according to an example of the present disclosure.
Figure 4:
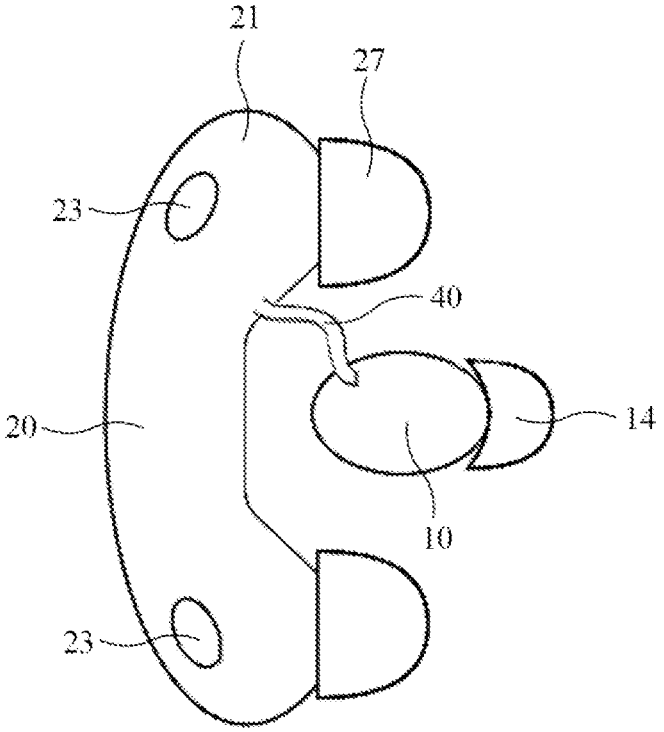
FIG. 4 is a partial sectional view of a headphone according to an example of the present disclosure.

In some examples, the headphone 20 further includes an earmuff-sealing ring 27 arranged at an end of a housing of the headphone 20 adjacent to the ear. Specifically, as shown in FIGS. 1 and 3, the earmuff-sealing ring 27 has a filtering effect on sound. When the earmuff 21 is fitted with the auricle 51, since the auricle 51 is not flat, there will be a gap between the earmuff 21 and the auricle 51, so that the external noise enters the earmuff 21 through the gap. The earmuff-sealing ring 27 is arranged at the end of the headphone 20 adjacent to the ear. The earmuff-sealing ring 27 is soft and can be fitted with the skin of the auricle 51, so as to isolate a lot of noise from the outside, thus improving the sound quality experience.

According to an example of the present disclosure, a multi-stage noise-cancellation earphone assembly is provided. As shown in FIG. 3, the multi-stage noise-cancellation earphone assembly includes an in-ear earphone 10 and a headphone 20. The in-ear earphone 10 is located in the accommodating space defined by the headphone 20 and the auricle 51. As shown in FIG. 3, the in-ear earphone 10 includes a second speaker 11 arranged at an in-ear end of the in-ear earphone 10 and configured to play an audio. When the headphone 20 is used in combination with the in-ear earphone 10, the earmuff 21 of the headphone 20 is fitted with the auricle 51 of the human ear, thus achieving a function of physical noise cancellation, that is, the passive noise cancellation. Under the support of the speaker, the in-ear earphone 10 achieves an audio output function. The second speaker 11 is inserted into the external auditory canal 52 of the user. The audio played by the first speaker 22 causes the air in the external auditory canal 52 to vibrate, the vibration reaches a tympanic membrane to cause a mechanical movement of an ossicular chain, the vibration of the stapes footplate causes a movement of the vestibular window, the energy is transferred to inner and outer lymph fluids in a cochlea and becomes liquid vibration, the movement of hair cells on a basement membrane produces a bioelectrical activity, and nerve impulses reach the auditory cortex center along uploading nerve pathways by virtue of the auditory nerve to produce hearing.

The earmuff pickup 23 of the headphone 20 can be combined with the first speaker 22, which may also achieve the function of active noise cancellation. Therefore, by the combination of the earmuff 21 of the headphone 20, the earmuff pickup 23 and the first speaker 22, both the passive noise cancellation and the active noise cancellation can be achieved at the same time. The passive noise cancellation of the headphone 20 physically provides a closed environment for the in-ear earphone 10 and hinders the interference of external noise. The active noise cancellation of the headphone 20 filters out part of the noise in the environment in advance for the in-ear earphone 10. By the combination of the passive noise cancellation and the active noise cancellation of the headphone 20 with the passive noise cancellation of the in-ear earphone 10, the problem of insufficient noise cancellation is solved through the multi-stage superposition, and the noise-cancellation effect is greatly improved. When the headphone 20 is used separately, the functions of the passive noise cancellation and the active noise cancellation of the headphone 20 itself can help the user avoid noise interference and adjust the mood. The headphone 20 isolates the noise damage to the eardrum.

In some examples, the in-ear earphone 10 further includes an earphone pickup 12. Specifically, the working principle of the earphone pickup 12 is the same with the working principle of the earmuff pickup 23. The earphone pickup 12 may be configured to collect an environmental sound, and the second speaker 11 may also be configured to play a noise-cancellation sound corresponding to the environmental sound collected by the earphone pickup 12. The in-ear earphone 10 may include two modes, i.e., an active noise-cancellation mode and a passive noise-cancellation mode. When the in-ear earphone 10 is in the passive noise-cancellation mode, the active noise-cancellation mode is disabled. When the in-ear earphone 10 is in the active noise-cancellation mode, the active noise-cancellation mode is enabled. The earphone pickup 12 of the in-ear earphone 10 is located on a side away from the in-ear end.

When the in-ear earphone 10 is used separately, the earphone pickup 12 of the in-ear earphone 10 can collect the external environmental sound, a microphone of the earphone pickup 12 may sample the noise heard by the human ear and the sampled noise is then transmitted to a processing chip in the in-ear earphone 10 via a circuit board and a signal transmission cable of the earphone pickup 12. The processing chip reverses and amplifies the noise collected by the earphone pickup 12, and then drives the second speaker 11 to play an "anti-noise". Playing the "anti-noise" is to play a noise-cancellation sound corresponding to the environmental sound collected by the earphone pickup 12, so as to cancel the noise transmitted from the outside into the human ear through the in-ear earphone 10. When the in-ear earphone 10 is used in combination with the headphone 20, the in-ear earphone 10 may enable the active noise-cancellation mode, and the headphone 20 may also enable the active noise-cancellation mode; or, the in-ear earphone 10 may enable the active noise-cancellation mode and the headphone 20 adopts the passive noise-cancellation mode; or, the in-ear earphone 10 adopts the passive noise-cancellation mode and the headphone 20 enables the active noise-cancellation mode; or, both the in-ear earphone 10 and the headphone 20 adopt the passive noise-cancellation mode at the same time.

When the in-ear earphone 10 and the headphone 20 are used in combination and both enable the active noise-cancellation mode, the working process of the headphone 20 and the in-ear earphone 10 is as follows.

The earmuff pickup 23 on the outer side of the earmuff 21 of the headphone 20 collects a sound in the external environmental of the earmuff 21. After the processing by the processing chip of the headphone 20, the first speaker 22 plays a sound in an opposite phase to the noise collected by the earmuff pickup 23 so as to neutralize the noise of the external environment. Since the in-ear earphone 10 is wrapped in the closed space defined by the headphone 20 and the auricle 51, the earphone pickup 12 is configured to collect a sound in the closed space. The sound in the closed space in this case is the sound obtained after the active noise-cancellation system of the headphone 20 neutralizes the noise of the external environment. After the processing by the processing chip of the in-ear earphone 10, the second speaker 11 plays a sound in an opposite phase to the noise collected by the earphone pickup 12 so as to neutralize the sound in the external environment and the closed space. In addition, the second speaker 11 also plays an audio sound selected by the user. Both the in-ear headphone 10 and the headphone 20 themselves have the function of passive noise cancellation. After both of them enable the active noise cancellation, a four-stage noise cancellation is achieved by the active noise cancellation and the passive noise cancellation of the headphone 20 as well as the active noise cancellation and the passive noise cancellation of the in-ear headphone 10.

When the in-ear headphone 10 enables the active noise cancellation and the headphone 20 adopts the passive noise cancellation, the noise-cancellation process of the headphone 20 and the in-ear headphone 10 is as follows.

In the closed space defined by the headphone 20 and the auricle 51, the passive noise-cancellation material of the headphone 20 filters out part of the external noise. The earphone pickup 12 of the in-ear earphone 10 collects the sound in the closed space in this case. After the sampled sound is processed by the processing chip of the in-ear earphone 10, the second speaker 11 of the in-ear earphone 10 plays a sound in an opposite phase to the sound collected by the earphone pickup 12 and also plays an audio sound selected by the user. In this case, a three-stage noise cancellation is achieved by the passive noise cancellation of the headphone 20 as well as the active noise cancellation and the passive noise cancellation of the in-ear earphone 10.

When the in-ear earphone 10 adopts the passive noise cancellation and the headphone 20 enables the active noise cancellation, the noise-cancellation process of the headphone 20 and the in-ear earphone 10 is as follows.

The earmuff pickup 23 of the headphone 20 collects the sound of the external environment. After the processing by the processing chip of the headphone 20, the first speaker 22 plays the noise-cancellation sound corresponding to the environmental sound collected by the earmuff pickup 23, so as to cancel the noise transmitted from the outside into the human ear through the earmuff 21. Subsequently, the passive noise cancellation is achieved by the passive noise-cancellation material of the in-ear earphone 10, and the second speaker 11 of the in-ear earphone 10 plays the audio sound selected by the user. In this case, a three-stage noise cancellation is achieved by the passive noise cancellation and the active noise cancellation of the headphone 20 as well as the passive noise cancellation of the in-ear earphone 10.

It should be noted that whether the in-ear earphone 10 adopts the active noise-cancellation mode or the passive noise-cancellation mode and whether the headphone 20 adopts the active noise-cancellation mode or the passive noise-cancellation mode can be selected by the user at will according to the use environment, so as to achieve the multi-stage noise cancellation, which is not limited specifically herein. The above description is provided as specific examples for illustration, but should not be understood as limitation on the scope of the present disclosure.

In some examples, the in-ear earphone 10 and the headphone 20 are detachably connected. It can be seen from the above description that the in-ear earphone 10 may be configured as an earphone having the passive noise cancellation, or an earphone that combines the active noise cancellation and the passive noise cancellation. Similarly, the headphone 20 may also be configured as a headphone having the passive noise cancellation, or a headphone that combines the active noise cancellation and the passive noise cancellation. As mentioned above, the in-ear earphone 10 and the headphone 20 may be used as earphones separately or in combination. When the in-ear earphone 10 and the headphone 20 are used in combination, the headphone 20 has the skeleton, and the two ends of the skeleton are each connected to one earmuff 21. Through the skeleton and the clamping force of the two earmuffs 21 on the auricle 51 of the head, a friction force is generated so that the headphone 20 is fixed at the auricle 51. The in-ear end of the in-ear earphone 10 is inserted into the external auditory canal 52 to achieve a fixing effect. Therefore, there may be no connector between the in-ear earphone 10 and the headphone 20.

The detachable connection between the in-ear earphone 10 and the headphone 20 means that the in-ear earphone 10 and the headphone 20 can be connected together by a connector. The connector may be a flexible connector or a fixed connector. The flexible connector may be a flexible connecting wire or the like, and the fixed connector may refer to a snap joint connection, or the like. The connector allows the in-ear earphone 10 and the headphone 20 to be detachably connected. When the in-ear earphone 10 and the headphone 20 are used at the same time, the two may be integrated to prevent one of them from falling and hence affecting the noise-cancellation effect. In addition, the connector also brings convenience for storage and arrangement. When the multi-stage noise-cancellation earphone assembly is not in use, the two earphones may be stored in one place, thereby preventing the headphone 20 or the in-ear earphone 10 from being lost due to separate placement.

In some examples, the in-ear earphone 10 further includes an air intake port, an air channel and an air exhaust port 13. The air intake port is arranged at a rear end opposite to the in-ear end, the air exhaust port 13 is arranged at the in-ear end, and the air channel communicates the air intake port with the air exhaust port 13.

The air intake port is configured to adjust an air pressure in the external auditory canal 52. Sound is transmitted to the human ear by sound waves. When the in-ear earphone 10 is inserted into the external auditory canal 52, the environment in the external auditory canal 52 becomes a closed environment. The sound heard by the ear may be a little dull, and the sound quality will change a little. A small hole (i.e., the air exhaust port 13) is formed in a side of the in-ear earphone 10 to balance the air pressures inside and outside the external auditory canal 52, thereby ensuring the sound quality and protecting the hearing of the ear.

An earphone body of the in-ear earphone 10 is provided with the air intake port and the air exhaust port 13, and the air intake port and the air exhaust port 13 are communicated by the air channel. The air intake port and the air exhaust port 13 are both located in the earphone body of the in-ear earphone 10. The air exhaust port 13 is located at the in-ear end of the in-ear earphone 10. When the in-ear earphone 10 is inserted into the external ear canal 52, the air exhaust port 13 also enters the external auditory canal 52 together. The air exhaust port 13 is in communication with the external auditory canal 52 so as to adjust the air pressure in the external auditory canal 52. The air intake port is located at a rear end of the earphone body of the in-ear earphone 10 away from the in-ear end, and the air intake port is in communication with the air outside the in-ear earphone 10 so that the outside air enters the air intake port. The air channel for communication between the air intake port and the air exhaust port 13 is located in the earphone body of the in-ear earphone 10. As can be seen from the above description, the air intake port of the in-ear earphone 10 is in communication with the outside air, the air exhaust port 13 is in communication with the air in the external auditory canal 52, and the air channel communicates the air intake port with the air exhaust port 13 so that the air in the external auditory canal 52 comes into communication with the air outside the in-ear earphone 10, thereby balancing the air pressure in the external auditory canal 52. When the in-ear earphone 10 is used separately, the air outside the in-ear earphone 10 passes through the air intake port of the in-ear earphone 10 and comes into communication with the air in the external auditory canal 52 via the air channel and the air exhaust port 13 so as to balance the air pressure in the external auditory canal 52.

When the in-ear earphone 10 is used in combination with the headphone 20, since the headphone 20 is provided with the air inlet and the air inlet is formed on the outer side of the earmuff 21, the air outside the earmuff 21 can enter the air inlet. In addition, the air inlet of the headphone 20 is in communication with the air intake port of the in-ear earphone 10 through the air duct 30, so that the air outside the earmuff 21 of the headphone 20 enters the air intake port of the in-ear earphone 10 through the air duct 30 from the air inlet of the headphone 20, and then comes into communication with the air in the external auditory canal 52 through the air channel and the air exhaust port 13 of the in-ear earphone 10, thereby balancing the air pressure in the external auditory canal 52. In addition, when the in-ear earphone 10 is used in combination with the headphone 20, the air blower 24 may be arranged at the air inlet, and the air outside the earmuff 21 of the headphone 20 can be actively sent into the air inlet of the headphone 20 by the rotation of the air blower 24. In this way, the situation where the air outside the earmuff 21 cannot come into communication with the air in the external auditory canal 52 due to the length or backfin of the air duct 30 can be avoided. Moreover, the air circulation and communication between the air outside the earmuff 21 and the air in the external ear canal 52 can also be sped up, and the active air supply better solves the problem of the stuffiness inside the in-ear earphone 10.

In addition, the air duct 30 is detachably arranged between the air inlet and the air intake port. When the headphone 20 is separated from the in-ear earphone 10 and used separately, the two ends of the air duct 30 can be detached from the air inlet of the headphone 20 and the air intake port of the in-ear earphone 10, respectively. In this way, when the headphone 20 and the in-ear earphone 10 are used separately, the air duct 30 will not affect the appearance and comfort. In addition, the air duct 30 may be made of a soft material or a hard material. When the air duct 30 is made of the soft material, it can be bent at will in the closed space defined by the inner side of the earmuff 21 and the auricle 51 according to the use environment. When the air duct 30 is made of the hard material, that is, the shape and structure of the air duct 30 are fixed and cannot be bent or changed, the phenomenon that the air duct 30 cannot be communicated due to non-human external forces can be avoided.

In some examples, the in-ear earphone 10 further includes an earplug head 14. The earplug head 14 is arranged at the in-ear end of the in-ear earphone 10, and the air exhaust port 13 is located at the second speaker 11.

Specifically, the in-ear end of the in-ear earphone 10 is inserted into the external auditory canal 52 of the ear, and the second speaker 11 is arranged at the in-ear end, so that the audio played by the second speaker 11 can be received by the human ear. The earplug head 14 is arranged outside of the in-ear end of the in-ear earphone 10 and surrounds the in-ear end.

The earplug head 14 may be made of a silicone material. Since the sound contact area of the in-ear earphone 10 is small, the pressure on the interior of the cochlea is relatively large. The earplug head 14 arranged at the in-ear end of the in-ear earphone 10 can reduce part of the pressure. The earplug head 14 is formed by processing and mold-pressing environmentally friendly soft silicone materials according to the ergonomic design. The biggest characteristic of the earplug head 14 lies in that the in-ear earphone 10 can be worn conveniently and comfortably, the damage to the ear by the in-ear end of the in-ear earphone 10 can be avoided, and the pain caused by the long-term wearing of the in-ear earphone can be addressed. With the earplug head 14, the user can do exercise more freely when wearing the earphone. In addition, the earplug head 14 also prevents the earphone from falling off due to strong vibrations during exercise, effectively protects earphone wires from erosions by perspiration or the like, and effectively prevents sweat erosion, thereby prolonging the service life of the earphone.

It can be seen from the above description that since the air exhaust port 13 is arranged at the in-ear end, the air exhaust port 13 can come into communication with the external auditory canal 52 when the in-ear end of the in-ear earphone 10 is inserted into the external auditory canal 52. The second speaker 11 is also arranged at the in-ear end, so the air exhaust port 13 is also arranged at the second speaker 11. The air exhaust port 13 can balance the air pressures inside and outside the external auditory canal 52, thereby ensuring the sound quality and protecting the hearing of the ear.

In some examples, the in-ear earphone 10 is configured as a wireless earphone, and/or the headphone 20 is configured as a wireless earphone. In this example, the in-ear earphone 10 is the wireless earphone. The in-ear earphone 10 may be connected to an electronic terminal device through a wireless connection manner such as Bluetooth and WiFi, and may receive signals transmitted by the electronic terminal device. The headphone 20 may be the wired earphone or the wireless earphone. The working principle of the headphone 20 configured as the wireless earphone is the same with the working principle of the earphone 10, and will not be repeated herein.

In summary, the present disclosure includes following advantages: 1. through the multi-stage superposed active noise cancellation, the problem of insufficient noise cancellation is solved, and the noise-cancellation effect is greatly improved; 2. the problem of the internal stuffiness caused by the sealing of the multi-stage noise-cancellation earphone assembly is solved by the active air supply; 3. the problem of the hair being crushed by the headphone is solved by adopting a three-dimensional contact support manner, and the hairstyle will not be ruined; 4. the combination of the headphone 20 and the in-ear earphone 10 ensures a long battery life of the in-ear headset 10, which solves the problem of the battery life of the in-ear headset 10.

It can be understood that in the present disclosure, "a plurality" refers to two or more than two, and other quantifiers are of the similar meaning to it. The wording "and/or" describes the association relationship of the associated objects, indicating that there may be three relationships. For example, A/or B may indicate three cases: only A exists, A and B exist at the same time, and only B exists. The character "/" generally indicates that the associated objects before and after are in an "or" relationship. The singular forms "a," "said" and "the" are also intended to include plural forms unless otherwise other meanings are explicitly indicated in the context.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be further understood that the terms "first", "second", etc. may be used to describe various types of information, but such information should not be limited to these terms. These terms are only used to distinguish the same type of information from each other, and do not indicate a specific order or a degree of importance. In fact, expressions such as "first" and "second" can be used interchangeably. For example, first information may also be referred to as second information without departing from the scope of the present disclosure. Similarly, the second information may also be referred to as the first information.

It should be further understood that, orientations or positional relationships indicated by terms "center", "longitudinal", "transverse", "front", "rear", "up', "down", "left", "right", "vertical", "horizontal", "top", "bottom", "inner", "outer", etc. are based on orientations or positional relationships shown in the accompanying drawings, and they are used only for describing the present disclosure and for description simplicity, but do not indicate or imply that an indicated apparatus or element must have a specific orientation or be constructed and operated in a specific orientation.

It can be further understood that, unless otherwise specified, "connection" includes a direct connection between two components without other components therebetween, and also includes an indirect connection between two components with other components therebetween.

It can be further understood that although the operations in the examples of the present disclosure are described in a specific order in the drawings, they should not be understood as requiring these operations to be performed in the specific order shown or requiring all the operations shown to be performed in order to obtain the desired result. In certain circumstances, multitasking and parallel processing may be advantageous.

Those skilled in the art will readily conceive of other implementation solutions of the present disclosure after considering this description and practicing the disclosure disclosed herein. The present disclosure is intended to cover any variations, uses, or adaptive changes of the present disclosure. These variations, uses, or adaptive changes follow the general principles of the present disclosure and include common knowledge or conventional technical means in the technical field that are not disclosed in the present disclosure. The description and the examples are only regarded as illustrative, and the true scope and spirit of the present disclosure are pointed out by the appended claims.

It should be understood that the present disclosure is not limited to the precise structure that has been described above and shown in the drawings, and various modifications and changes can be made without departing from the scope of the present disclosure. The scope of the present disclosure is only limited by the appended claims.

What is claimed is:

1. A headphone, configured to be used in combination with an in-ear earphone, comprising:

an earmuff configured to be fitted over an auricle;

an earmuff pickup disposed on an outer side of the earmuff and configured to collect an environmental sound; and a first speaker disposed on an inner side of the earmuff and configured to perform at least one of following actions: playing a noise-cancellation sound corresponding to the environmental sound collected by the earmuff pickup, or playing an audio, wherein when the headphone is in use, the inner side of the earmuff and the auricle define an accommodating space for accommodating a part of the in-ear earphone exposed out of an external auditory canal, wherein the headphone further comprises:

an air inlet disposed on the outer side of the earmuff;

an air blower disposed on the earmuff and communicated with the air inlet; and an air duct configured to communicate the air inlet with the in-ear earphone.

2. The headphone according to claim 1, further comprising a charging cable configured to connect a battery of the headphone to a battery of the in-ear earphone.

3. The headphone according to claim 1, further comprising:

a skeleton, two ends of the skeleton being each connected to two earmuffs, respectively; and a support body disposed on a side of the skeleton facing a user's head when the headphone is worn, and configured for preventing the skeleton from coming into contact with the head.

4. The headphone according to claim 3, wherein the support body comprises a plurality of support pillars, and the plurality of support pillars are distributed on the skeleton at intervals in an array.

5. The headphone according to claim 1, further comprising an earmuff-sealing ring arranged at an end of the earmuff adjacent to the auricle for closing the accommodating space.

6. The headphone according to claim 1, wherein the headphone is configured as a wired earphone or a wireless earphone.

7. A multi-stage noise-cancellation earphone assembly, comprising:

a headphone comprising:

an earmuff configured to be fitted over an auricle;

an earmuff pickup disposed on an outer side of the earmuff and configured to collect an environmental sound; and a first speaker disposed on an inner side of the earmuff and configured to perform at least one of following actions: playing a noise-cancellation sound corresponding to the environmental sound collected by the earmuff pickup, or playing an audio, wherein the inner side of the earmuff is configured to define an accommodating space with the auricle when the headphone is in use; and an in-ear earphone, wherein when the multi-stage noise-cancellation earphone assembly is in use, an in-ear end of the in-ear earphone is located in an external auditory canal, a part of the in-ear earphone exposed out of the external auditory canal is located in the accommodating space, wherein the headphone further comprises:

an air inlet disposed on the outer side of the earmuff;

an air blower disposed on the earmuff and communicated with the air inlet; and an air duct configured to communicate the air inlet with the in-ear earphone.

8. The multi-stage noise-cancellation earphone assembly according to claim 7, wherein the in-ear earphone comprises a second speaker disposed at the in-ear end of the in-ear earphone and configured to play an audio.

9. The multi-stage noise-cancellation earphone assembly according to claim 8, wherein the in-ear earphone further comprises an earphone pickup configured to collect a sound in the accommodating space, and the second speaker is further configured to play a noise-cancellation sound corresponding to the sound collected by the earphone pickup.

10. The multi-stage noise-cancellation earphone assembly according to claim 7, wherein the in-ear earphone further comprises:

an air intake port disposed at a rear end of the in-ear earphone opposite to the in-ear end;

an air exhaust port disposed at the second speaker; and an air channel communicating the air intake port with the air exhaust port.

11. The multi-stage noise-cancellation earphone assembly according to claim 7, wherein the in-ear earphone further comprises an earplug head disposed at the in-ear end of the in-ear earphone and configured to close the external auditory canal.

12. The multi-stage noise-cancellation earphone assembly according to claim 7, wherein the in-ear earphone and the headphone are detachably connected.

13. The multi-stage noise-cancellation earphone assembly according to claim 7, wherein the in-ear earphone is configured as a wireless earphone.

14. The multi-stage noise-cancellation earphone assembly according to claim 7, further comprising a charging cable configured to connect a battery of the headphone to a battery of the in-ear earphone.

15. The multi-stage noise-cancellation earphone assembly according to claim 7, further comprising:

a skeleton, two ends of the skeleton being each connected to two earmuffs, respectively; and a support body disposed on a side of the skeleton facing a user's head when the headphone is worn, and configured for preventing the skeleton from coming into contact with the head.

16. The multi-stage noise-cancellation earphone assembly according to claim 15, wherein the support body comprises a plurality of support pillars, and the plurality of support pillars are distributed on the skeleton at intervals in an array.

17. The multi-stage noise-cancellation earphone assembly according to claim 7, further comprising an earmuff-sealing ring disposed at an end of the earmuff adjacent to the auricle for closing the accommodating space.

18. The multi-stage noise-cancellation earphone assembly according to claim 7, wherein the headphone is configured as a wired earphone or a wireless earphone.

19. A headphone, configured to be used in combination with an in-ear earphone, comprising:

an earmuff configured to be fitted over an auricle;

an earmuff pickup disposed on an outer side of the earmuff and configured to collect an environmental sound; and a first speaker disposed on an inner side of the earmuff and configured to perform at least one of following actions: playing a noise-cancellation sound corresponding to the environmental sound collected by the earmuff pickup, or playing an audio, wherein when the headphone is in use, the inner side of the earmuff and the auricle define an accommodating space for accommodating a part of the in-ear earphone exposed out of an external auditory canal, wherein the headphone further comprises:

a skeleton, two ends of the skeleton being each connected to one earmuff; and a support body disposed on a side of the skeleton facing a user's head when the headphone is worn, and configured for preventing the skeleton from coming into contact with the head, wherein the support body comprises a plurality of support pillars, and the plurality of support pillars are distributed on the skeleton at intervals in an array.

* * * * *